US006448819B2

(12) United States Patent
Lin

(10) Patent No.: US 6,448,819 B2
(45) Date of Patent: Sep. 10, 2002

(54) FIXED DEVICE FOR THE BULB SOCKET

(76) Inventor: Chi Hua Lin, No. 304, Sing-Sun Road, Chu-Dong, Hsin-Chu Hsien (TW)

( * ) Notice: Subject to any disclaimer, the term of this patent is extended or adjusted under 35 U.S.C. 154(b) by 0 days.

(21) Appl. No.: 09/892,555

(22) Filed: Jun. 28, 2001

Related U.S. Application Data

(63) Continuation-in-part of application No. 09/546,175, filed on Apr. 11, 2000.

(51) Int. Cl.[7] ..... H01R 33/00
(52) U.S. Cl. ..... 326/226; 439/619; 439/375
(58) Field of Search ..... 362/226; 439/619, 439/375; 313/318.09, 318.1, 318.01

(56) References Cited

U.S. PATENT DOCUMENTS 4,724,353 A * 2/1988 Devir ..... 313/318
4,883,434 A * 11/1989 Toyoshima ..... 439/619
5,934,791 A * 8/1999 Van Gennip et al. ..... 362/226
6,056,417 A * 5/2000 Cheng ..... 362/226
6,083,050 A * 7/2000 Hsu ..... 439/619

* cited by examiner

*Primary Examiner*—Thomas M. Sember
*Assistant Examiner*—Jacob Y. Choi
(74) *Attorney, Agent, or Firm*—Rabin & Berdo, P.C.

(57) ABSTRACT

A bulb socket and bulb arrangement includes a jacket set at a caulking part above the fixture of the bulb socket. There are several jack catches inside the jacket. The outer part of the bulb has several convex catches. When the bulb is inserted into the bulb socket, the convex catches of the bulb will be geared between the jack catches within the jacket. Such an engagement can fix the bulb with the fixture of the bulb socket more effectively.

9 Claims, 4 Drawing Sheets

FIXED DEVICE FOR THE BULB SOCKET

This present application represents a continuation-in-part (C.I.P) of U.S. patent application Ser. No. 09/546,175 filed on Apr. 11, 2000, which is incorporated herein by reference.

TECHNICAL FIELD

The present invention provides a C.I.P. of U.S. patent application Ser. No. 09/546,175, namely, an improved fixed device for the bulb socket. It particularly refers to a jacket set on the fixed device for the bulb socket and a number of jack catches set inside the jacket for fixation to the bulb.

BACKGROUND OF THE INVENTION

The inventor applied for U.S. patent application Ser. No. 09/546,175, in which, a concave ratchet-shaped jack catch as a stopping device is disposed on every flank of the leading-in socket of the bulb socket, and a convex ratchet-shaped jack catch as a resistance device is disposed on an inner-side of the fixing frame. During fabrication, utilizing the fixing frame to connect with the leading-in socket of the bulb socket, means the stopping device will gear with the resistance device in a secure combination. Hence, a firm connection of the fixing frame and the leading-in socket serves to avoid the operation of a heat pressing and forms a more secure connection than is achieved through a conventional high-frequency soldering.

The above mentioned application only discussed the connection between the leading-in socket and the fixing frame. However, no better solution of the connection between the bulb and the bulb socket was disclosed. In the past, as the bulb was fabricated onto the bulb socket, of its fixation was not fastening enough which reduced to the bulb in a slippage.

A chief object of the present invention is to provide a device for effectively fixing the bulb on the bulb socket.

Secondly, the invention has designed a jack catch inside a jacket to reinforce the connection between the bulb and the bulb socket.

In order for the members of the examination committee are enable to further understand the objects, features and functions of the invention, a example as well as drawings are offered as follows:

A BRIEF DESCRIPTION OF DRAWINGS

Figure 1:
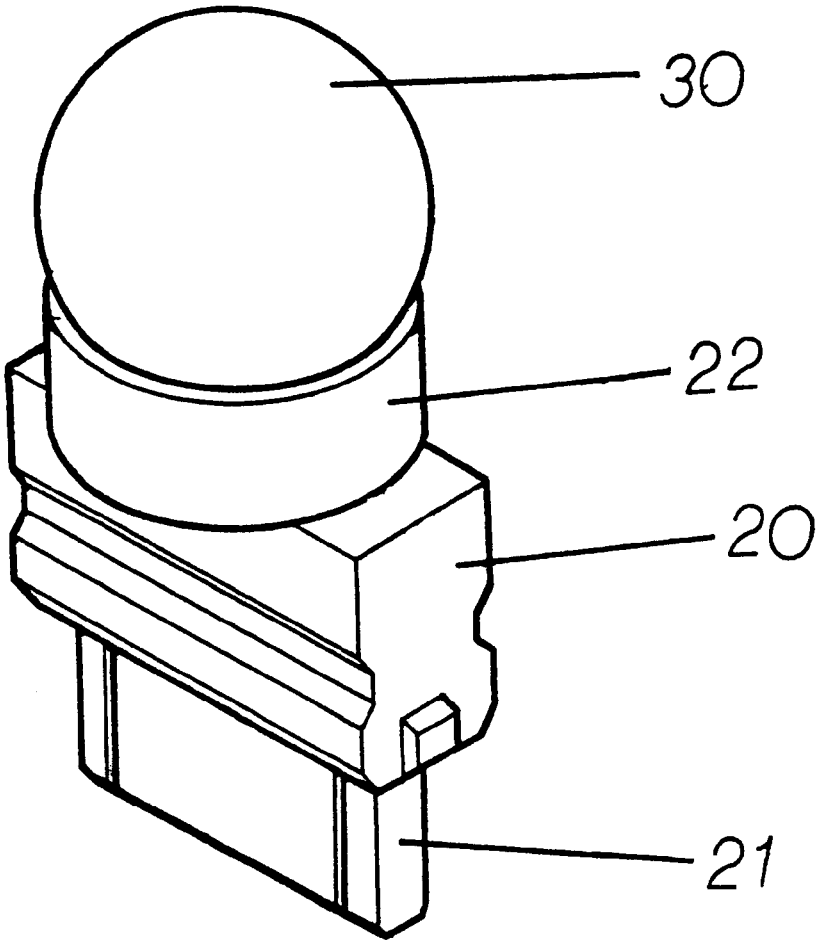

FIG. 1: The compound drawing of the invention.

Figure 2:
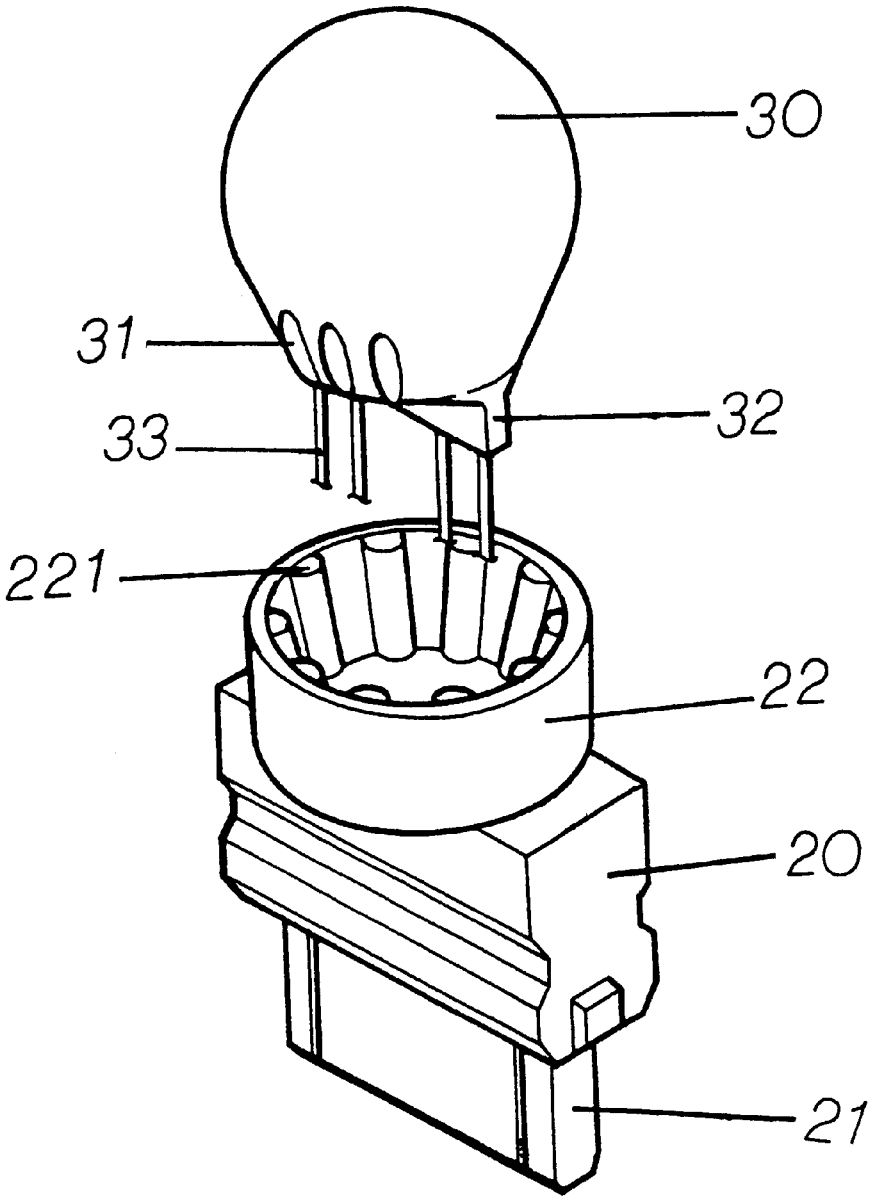

FIG. 2: The breakdown drawing of the invention.

Figure 3:
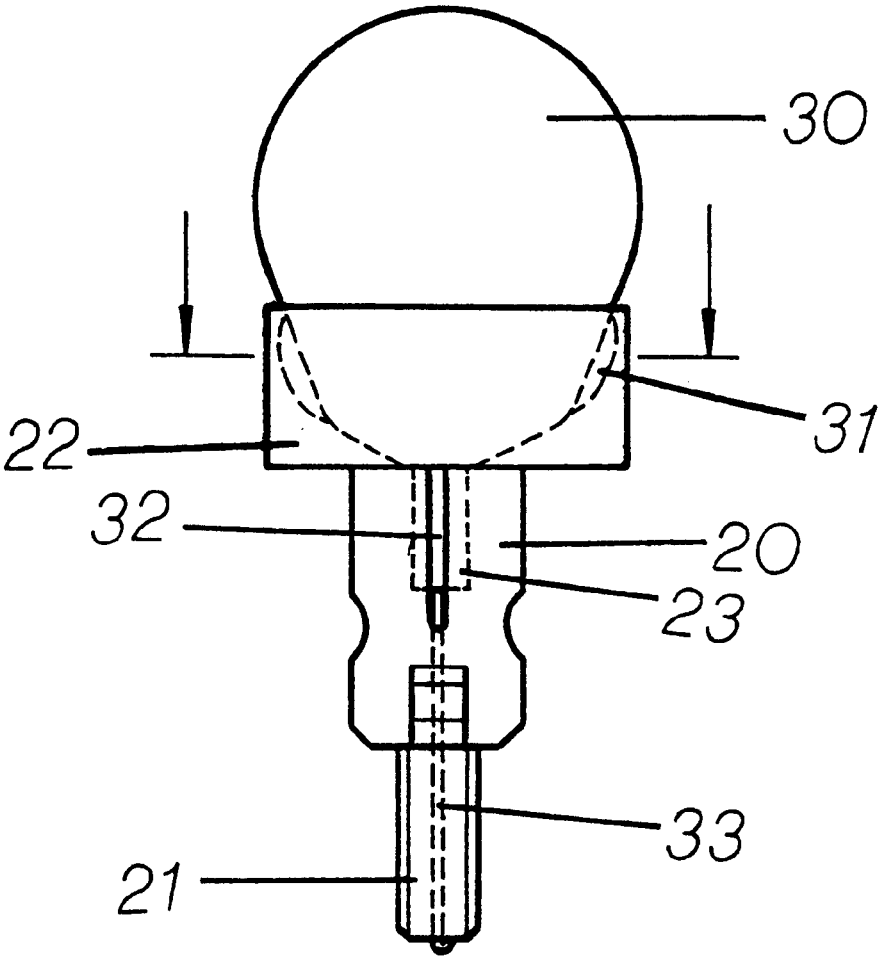

FIG. 3: The side-elevation drawing of the invention.

Figure 4:
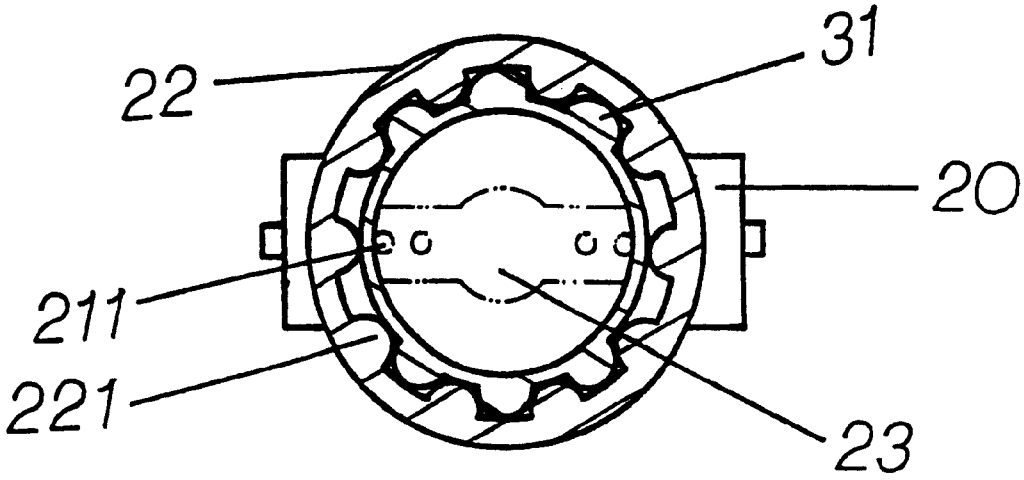

FIG. 4: The composed plan-view drawing of the invention.

(20) bulb socket.
(21) leading-in socket.
(22) jacket.
(23) caulking groove.
(30) bulb
(31) convex catch.
(32) bulb-neck.
(33) filament joint.
(211) hole.
(221) jack catch.

A DETAILED DESCRIPTION OF THE INVENTION

Please refer to FIGS. 1 and 2. The bulb socket is composed of a bulb socket (20) and a jacket (22) that defines an opening. The bulb socket (20) has integrated form and is made of engineering plastics. A flat leading-in socket (21) extends from one of its ends.

As is shown in FIG. 3, there is a caulking groove (23) on the plane part of the bulb socket (20). The caulking groove (23) is encircled by the jacket (22). There are ten jack catches (221) inside the jacket (22). There are three convex (i.e., curved or rounded like the exterior or a sphere of circle) catches (elongated ridges) (31) around transparent bulbous portion of the bulb (30). Besides, there are three convex catches (31) opposite to it. The neck (32) of the bulb (30) is connected with four electric filament joints (33) fixed on the bulb socket (20). When connected, the bulb-neck (32) can be inserted into the caulking groove (23) while the filament joint (33) goes through the leading-in socket (21). Furthermore, the filament joint (33) is bent and flatly attached onto the surface of the leading-in socket (21) for forming the positive and negative electric wires.

Please refer to FIGS. 2, 3 and 4. The filament joint (33) of the bulb (30) is in direct correspondence to the hole (211) on the base of the leading-in socket (21), in which the entire bulb (30) is inserted from upwardly to bottomwardly, then into the jacket (21) of the bulb socket (20). Thus, the filament joint (33) will go through the leading-in socket (21) and the filament joint (33) will further be bent and flatly attached onto the surface of the leading-in socket (21) for forming the positive and negative electric wires. As the structure in integrated, each convex catch (31) outside the bulb (30) will be geared with a jack catch (elongated, spaced-apart convex ridges) (221) inside the jacket (22) as well as integration of every jack catch (221). This is a more secure fixture for the bulb (30) and bulb socket (20) than others.

All in all as mentioned above, the practicability of this invention goes beyond doubts and conforms to the legal stipulations required by patent laws, accordingly, this application is applying for this matter.

What is claimed is:

1. A bulb and bulb socket arrangement, comprising:

a bulb having transparent bulbous portion and a plurality of spaced apart catches on the bulbous portion and a neck attached to a base of the bulbous portion; and a bulb socket having a leading-in socket disposed at a lower end thereof, and having a jacket disposed at an upper end thereof, said jacket defining an opening for receiving a base of said bulbous portion and said neck, said bulb socket further having a plurality of elongated, spaced-apart ridges, each ridge being disposed on an inside wall of said jacket and projecting into the opening, and said ridges having a length extending in a direction from the upper end toward the lower end of said bulb socket, wherein when said bulb is received within the opening, each said catch is disposed in a space between two respective adjacent ones of said ridges, thereby securing said bulb to said bulb socket.

2. The bulb and bulb socket arrangement recited in claim 1, wherein each said catch comprises a convex elongated ridge, each ridge extending in a direction toward the base of the bulbous portion.

3. The bulb and bulb socket arrangement recited in claim 2, wherein at least one of said convex ridges is disposed on one side of said bulb, and at least another one of said convex ridges is disposed on an opposite side of said bulb.

4. The bulb and bulb socket arrangement recited in claim 3, wherein a plurality of said convex ridges is disposed on the one side of said bulb, and a plurality of further ones of said convex ridges is disposed on the opposite side of said bulb.

5. The bulb and bulb socket arrangement recited in claim 2, wherein the opening has a circular shape.

6. The bulb and bulb socket arrangement recited in claim 1, wherein each said elongated, spaced-apart ridge has a convex profile.

7. The bulb and bulb socket arrangement recited in claim 1, wherein said elongated, spaced-apart ridges are disposed around an entire periphery of the opening.

8. The bulb and bulb socket arrangement recited in claim 7, wherein ten of said elongated, spaced-apart ridges are disposed around the entire periphery of the opening.

9. The bulb and bulb socket arrangement recited in claim 8, wherein the periphery of the opening defines a circular shape.

* * * * *